US009928941B2

(12) United States Patent
Felgenhauer et al.

(10) Patent No.: US 9,928,941 B2
(45) Date of Patent: Mar. 27, 2018

(54) IMPEDANCE MATCHING DEVICE

(71) Applicant: DELPHI TECHNOLOGIES, INC., Troy, MI (US)

(72) Inventors: Reinhard Felgenhauer, Iserlohn (DE); Michael Rucks, Schwerte (DE)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/109,866

(22) PCT Filed: Jan. 21, 2015

(86) PCT No.: PCT/EP2015/051137
§ 371 (c)(1),
(2) Date: Jul. 6, 2016

(87) PCT Pub. No.: WO2015/110469
PCT Pub. Date: Jul. 30, 2015

(65) Prior Publication Data

US 2016/0329126 A1 Nov. 10, 2016

(30) Foreign Application Priority Data

Jan. 21, 2014 (EP) ..... 14152032

(51) Int. Cl.
*H01R 9/05* (2006.01)
*H01B 7/00* (2006.01)
*H01P 5/02* (2006.01)
*H01B 13/00* (2006.01)

(52) U.S. Cl.
CPC ..... *H01B 7/009* (2013.01); *H01B 13/0023* (2013.01); *H01P 5/02* (2013.01)

(58) Field of Classification Search
CPC ..... H01B 7/009; H01B 13/0023; H01R 7/02
USPC ..... 174/74 R, 78, 84 R, 84 C, 92; 333/4
See application file for complete search history.

(56) References Cited

U.S. PATENT DOCUMENTS 2,267,268 A * 12/1941 Burrows ..... H03H 7/383 174/32
2,405,174 A * 8/1946 Alford ..... H01P 5/02 333/33
2,769,169 A * 10/1956 Munzig ..... H01Q 9/16 174/157
3,686,594 A * 8/1972 Hoppis ..... H01P 5/028 333/246

(Continued)

OTHER PUBLICATIONS

Victor F. Veley: "Modem Microwave Technology", Jan. 1, 1987, Prentice Hall, USA, XP002725376, ISBN: 0-13-595414-2, p. 44.

*Primary Examiner* — William H Mayo, III
(74) *Attorney, Agent, or Firm* — Robert J. Myers

(57) ABSTRACT

An electrical cable includes a first wire conductor separated from a second wire conductor and a compensation area proximate to, but separated from, an end portion of the cable and a method of manufacturing such an electrical cable. The first and second wire conductors are each connected to a contact element. The first and second wire conductors are separated by a first distance within the compensation area. The first and second wire conductors are separated by a second distance outside of the compensation area. The first distance is less than the second distance, thereby decreasing an impedance of the cable within the compensation area.

11 Claims, 4 Drawing Sheets

(56) References Cited

U.S. PATENT DOCUMENTS

| | | | | |
|---|---|---|---|---|
| 4,823,095 | A * | 4/1989 | Atallah | H01R 13/7039 333/22 R |
| 5,384,690 | A * | 1/1995 | Davis | H01R 12/613 174/262 |
| 5,663,660 | A * | 9/1997 | Fromion | H04L 25/0278 326/30 |
| 6,781,051 | B1 * | 8/2004 | Linossier | H01Q 13/20 174/102 R |
| 2004/0000963 | A1 * | 1/2004 | Killen | H01P 5/02 333/35 |
| 2009/0154120 | A1 * | 6/2009 | Ueyama | H05K 1/0219 361/760 |

* cited by examiner

IMPEDANCE MATCHING DEVICE

CROSS-REFERENCE TO RELATED APPLICATION

This application is a national stage application under 35 U.S.C. § 371 of PCT Application Number PCT/EP2015/051137 having an international filing date of Jan. 21, 2015, which designated the United States, said PCT application claiming the benefit of priority under Article 8 of the Patent Cooperation Treaty to European Patent Application No. 14152032.0, having a filing date of Jan. 21, 2014, the entire disclosure of each of which are hereby incorporated herein by reference.

TECHNICAL FIELD OF THE INVENTION

The invention relates to an electrical cable, in particular to an electrical cable for transmission of data at high speed. It is particularly suitable for transmitting data in vehicles.

BACKGROUND OF THE INVENTION

In the design of modern vehicles, implementing security technology and multimedia applications, design engineers are anew confronted with problems which were originally known only in computer technology. The data rates of the cables are rising rapidly, whereby requirements regarding the electrical cables and connection systems in vehicles increase. With today's transmission rates of 100 Mbit/s and in future far more, high frequency influences play an ever increasing role. Today, the entire transmission path needs to be considered in the design of the line set, since it is not only a sequence of connectors and cables. Transmission systems, such as e.g. Broad-R Reach, have specific requirements for the associated transmission channel. Among other things, these are the maximum allowed reflections within the bandwidth relevant to the system. The reflection performance of the transmission path is characterized by the reflection attenuation in the relevant frequency range. In an analog way, characterization in the time domain is possible by the variation of the impedance along the transmission path, since changes of the wave length on the path are the cause of reflections. The variation of the impedance is measured using a time domain reflectometer (TDR). In this case, the reflected signal, when excited by a step function, is recorded and the time variation Z(t) of the impedance is determined therefrom.

Only the frequency components of the reflected signal within the system-relevant bandwidth are of importance for the quality of the transmission path. With TDR the result Z(t) is filtered accordingly or the stimulating step function is limited in its rise time. With Broad R Reach standard, the specified rise time is $t_r$=700 picoseconds. For the local variation the bandwidth limit acts as reduced spatial resolution. The result in the end is a system-relevant variation of impedance.

With respect to the optimum impedance, standard connector systems have generally a system-relevant value which is too high due to component geometry and material properties which are not to be changed. In particular, the areas in which the carrier medium of the signals changes, for example, from circuit board to connector or from connector to electrical line, cause major problems. In today's technology, mainly lines for transmission of data are used having two mutually twisted wires (twisted pair). These lines have good transmission characteristics, as long as the wires of the line are close to each other. If the wires are separated from each other, which inevitably is the case when connecting the wires with a connector, the transmission characteristics of the line change significantly. The conductive elements in the connector, which is connected to the line, normally do not correspond in geometry to the route of the wires. The design of the connector is within constructive limits, which are largely dictated by space and costs. Available connector systems that accommodate the requirements of high data rates are usually expensive and inflexible. Therefore, difficulties in adjustment between connector and cable cannot be completely avoided.

BRIEF SUMMARY OF THE INVENTION

The invention is based on the object of providing a cable, which can be easily customized to an existing connector system, to transmit data at high data rates and with low interference through this system of cable and connector.

According to one embodiment of the invention, a cable with matched impedance having at least two conductors which are separated from each other by insulation and are connectable to contact elements is provided. The cable includes a compensation area within its end portion. Within the compensation area, the distance of the conductors from each other is smaller than outside the compensation area, thereby the impedance of the cable decreases in the compensation area.

A clamping means may engage the cable in the compensation area and presses it together such that the distance of the conductors from each other is reduced.

An intermediate layer may extend, at least in sections, between the cable and the clamping means.

The intermediate layer may have a higher permittivity than the clamping means.

The conductors of the cable may each comprise circumferential insulations, wherein the insulations are welded together at least in the compensation area.

The end portion may be smaller than 70 mm.

The length of the compensation area and the distance of the conductors from each other may be selected such that a predetermined impedance value is not exceeded.

According to another embodiment of the invention, a method of manufacturing a cable is provided. The method includes the steps of providing a cable having at least two conductors, which are insulated from each other, in a compensation area within an end portion of the cable. Then, reducing the distance of the conductors from each other within the compensation area. Then, fixing the distance of the conductors from each other within the compensation area.

The method steps of reducing the distance of the conductors from each other and fixing the distance of the conductors from each other may be performed by clamping using a clamping means.

The method steps of reducing the distance of the conductors from each other and fixing the distance of the conductors from each other may be performed by introducing thermal energy into the compensation area such that the insulation is welded.

The method step of reducing the distance of the conductors from each other may include introducing thermal energy into the compensation area.

According to yet another embodiment of the invention, a cable with matched impedance, including a cable having at least two conductors which are separated from each other by insulation and are connectable to contact elements is provided. The cable includes a compensation area within its end portion, the cable comprises within the compensation area a cover with electrically conductive material, whereby the cable has a lower impedance within the compensation area.

The cable in the compensation area may be coated with a metallic or metal containing material. Alternatively, the cable in the compensation area may be coated with an electrically conductive plastic material or coating. Yet further alternatively, the cable in the compensation area may be coated with a coating comprising graphite and/or carbon.

BRIEF DESCRIPTION OF THE SEVERAL VIEWS OF THE DRAWING

In the following, the invention will be described by an advantageous embodiment by way of example only with reference to the attached drawings, in which.

DETAILED DESCRIPTION OF THE INVENTION

Figure 1:
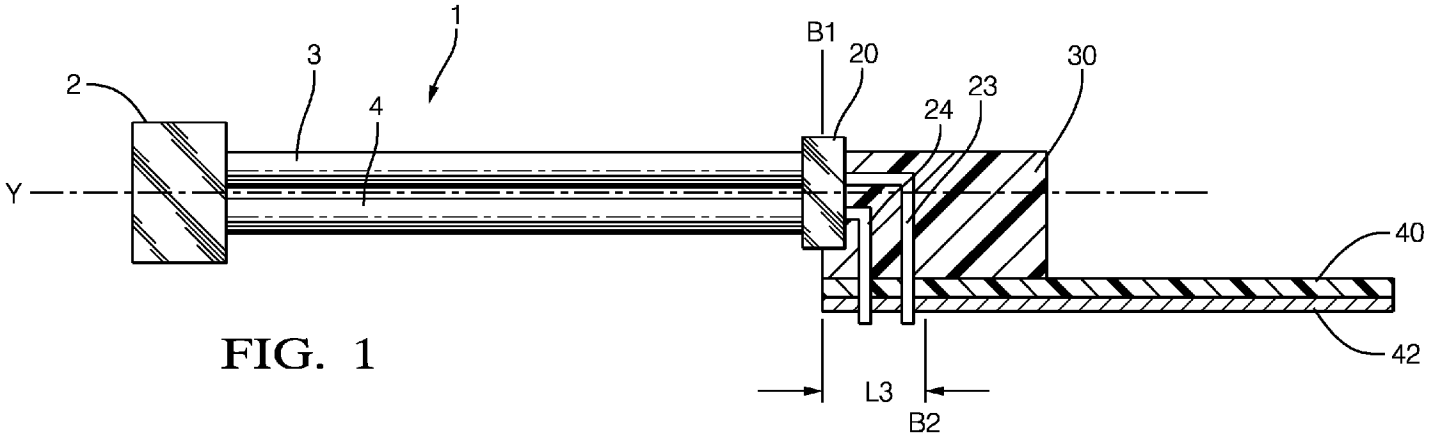
FIG. 1 schematically shows a connection arrangement according to the prior art.

FIG. 1 schematically shows a connection arrangement of the prior art. A cable 1 is connected by means of a connector 20 with a socket 30 (header). The socket 30 is attached to a printed circuit board 40. The conductors 11, 13 of the wires 3, 4 are electrically connected to the socket contacts 23, 24. The socket contacts 23, 24 are in turn electrically connected to the conductive traces 42 of the printed circuit board 40. The variation W1 of the impedance Z along the longitudinal axis Y of the cable 1 and of the connection 20, 30 to the connection points of the socket contacts 23, 24 to the conductive traces 42 on the printed circuit board 40 of the socket 30 is schematically shown in the diagram in FIG. 7. As can be seen, the impedance Z along the area L2 to the handover point B1 is not changed significantly. In the interference area L3 between the handover point B1 and the handover point B2, the impedance Z changes significantly. Within the socket 30, the sockets contacts 23, 24 are at a greater distance from each other than in the cable 1. This circumstance causes a change of the impedance Z in said interference area L3. The conductive traces 42 on the printed circuit board 40 can be formed such that the impedance corresponds substantially to the impedance of the cable 1 in the area L2.

Figure 2:
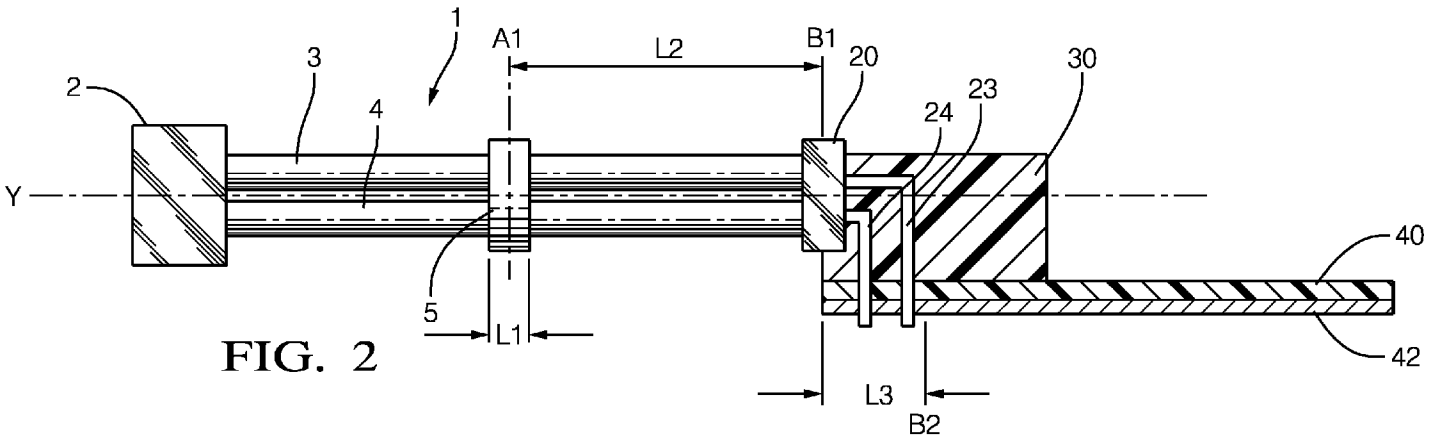
FIG. 2 shows the structure of FIG. 1 with attached clamping element according to one embodiment.

FIG. 2 shows the same structure as shown in FIG. 1, however additionally provided with a clamping means 5 which is attached to the cable 1 near the handover point B1. In this embodiment, the clamping means 5 is implemented as metal sleeve. The clamping means 5 is mounted in an end portion L2 of the cable 1. The length of the end portion L2 depends largely on the frequency of the signal which is to be transmitted. The clamping means 5 surrounds an area L1 of the cable 1. The length of the area L1 is adapted to the structure of the line-connector combination. The clamping means 5 is placed around the wires 3, 4 such that it holds together the wires 3, 4 tightly or even exerts pressure on the wires 3, 4.

Figure 3A:
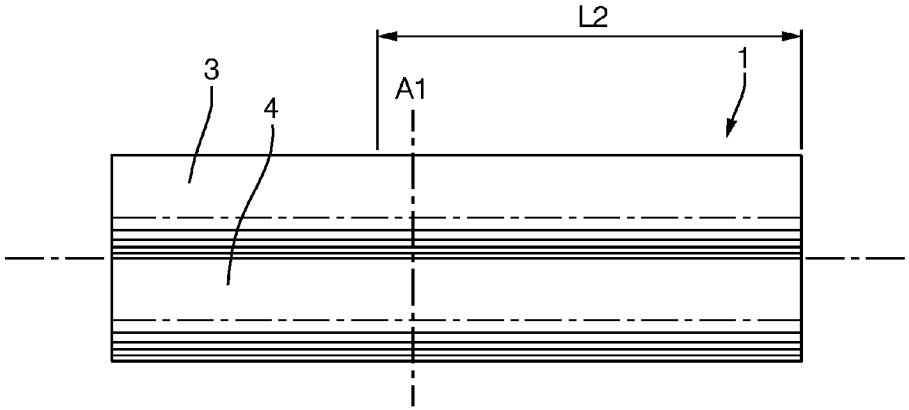
FIG. 3*a* shows a portion of a cable according to one embodiment.
Figure 3B:
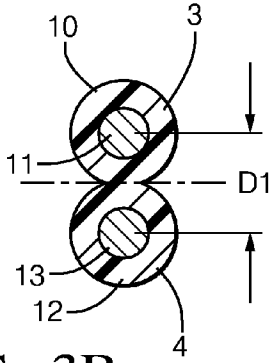
FIG. 3*b* shows a sectional view of the cable, wherein the section is transverse to the longitudinal axis Y, along the axis A1 according to one embodiment.

FIGS. 3*a* and 3*b* show an area of the cable 1, comprising the end portion L2. FIG. 3*a* shows the wires 3, 4 in parallel extending along the longitudinal axis Y. A sectional axis A1 is shown in the end portion L2. FIG. 3B shows a sectional view of the cable 1 along the axis A1. It can be seen in the sectional view that the two wires 3, 4 are adjacent to each other, so that the distance D1 of the center points of the conductors 11, 13 corresponds approximately to the diameter of a wire 3, 4 of the cable 1.

Figure 4A:
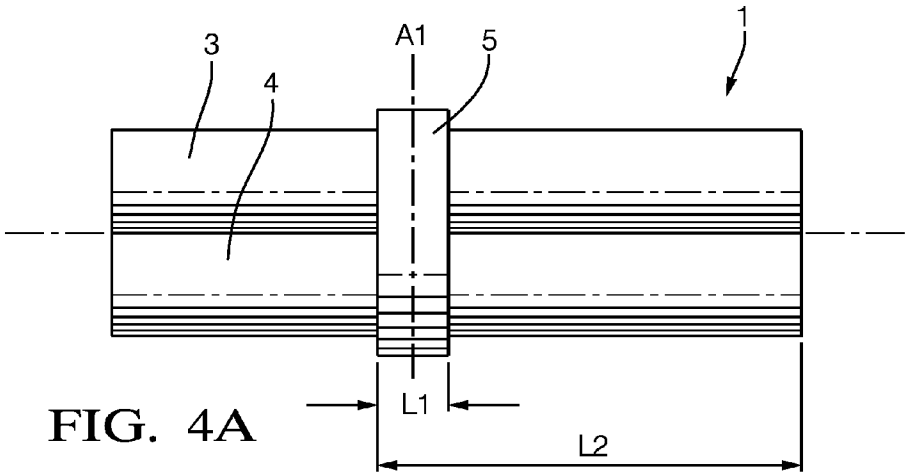
FIG. 4*a* shows a portion of the cable with attached clamping element according to one embodiment.
Figure 4B:
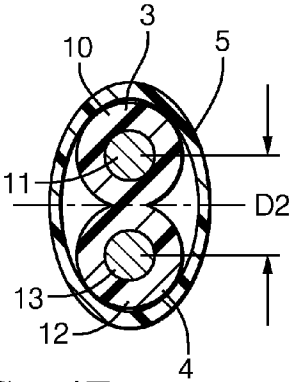
FIG. 4*b* shows a section, transverse to the longitudinal axis Y, along the axis A1, of the cable with the clamping element according to one embodiment.

FIGS. 4*a* and 4*b* also show an area of cable 1, which comprises the end portion L2. In this illustration, a clamping means 5 is mounted in the end portion of the cable 1. A sectional axis A1 is shown in the end portion L2 which runs through the clamping means 5 and the compensation area L1. FIG. 4B is a sectional view of the cable 1 along the axis A1. It can be seen in the sectional view that the two conductors 11, 13 here are closer to each other. The distance D2 between the center points of the wires 3, 4 is now smaller than the distance D1. The insulation 10, 12 of the wires 3, 4 is deformed in the compensation area L1 so that the conductors 11, 13 are closer to each other.

Figure 5:
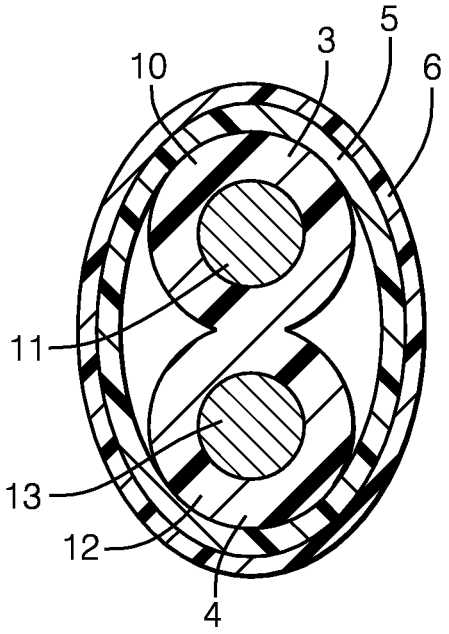
FIG. 5 shows a clamping element with an intermediate layer according to one embodiment.

FIG. 5 shows a sectional view of the compensation area L1, as already shown in FIG. 4*b*. However, here an intermediate layer 6 is a placed between the clamping means 5 and the cable 1. The intermediate layer 6 may be deformed when the clamping means 5 is deformed by pressing. By the deformed intermediate layer 6, spaces between the clamping means 5 and the insulation 10, 12 can be filled. On actuation, the clamping means 5 presses indirectly onto the insulation 10, 12 of the conductors 11, 13 so that the conductors are only pressed to each other when the intermediate layer 6 is deformed. If a material with high permittivity is chosen for the intermediate layer 6, this has a beneficial effect on the impedance. The intermediate layer 6 additionally lowers the impedance Z. This results in that the conductors 11, 13 need to be brought less close to each other to achieve the desired impedance value. Materials with beneficial characteristics for the intermediate layer 6 are for example: rubber or silicone. Basically, any elastomer may be used.

Figure 6:
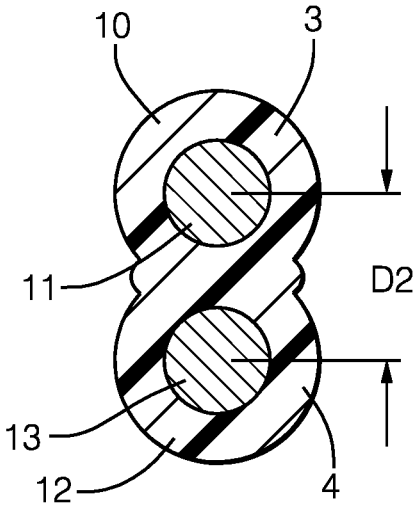
FIG. 6 shows two wires with welded insulation according to one embodiment.

FIG. 6 shows a sectional view of compensation area L1 along the section axis A1 as already shown in FIG. 4*b* and FIG. 5. In this embodiment, the compensation area L1 has no clamping means. The compensation effect is achieved by welding together the insulation 10, 12 of the wires 3, 4. Insulation 10, 12 of one or both the wires 3, 4 is/are melted and then pressed together to achieve a predetermined conductor distance D2. The melted insulation 10, 12 is partially pressed out of the space 14 between the wires 3, 4 such that the conductors 11, 13 are positioned closer together. After solidification of the insulation 10, 12, the insulation 10, 12 of the wires 3, 4 are partially welded together and the positions of the conductors 11, 13 are fixed to each other.

Figure 7:
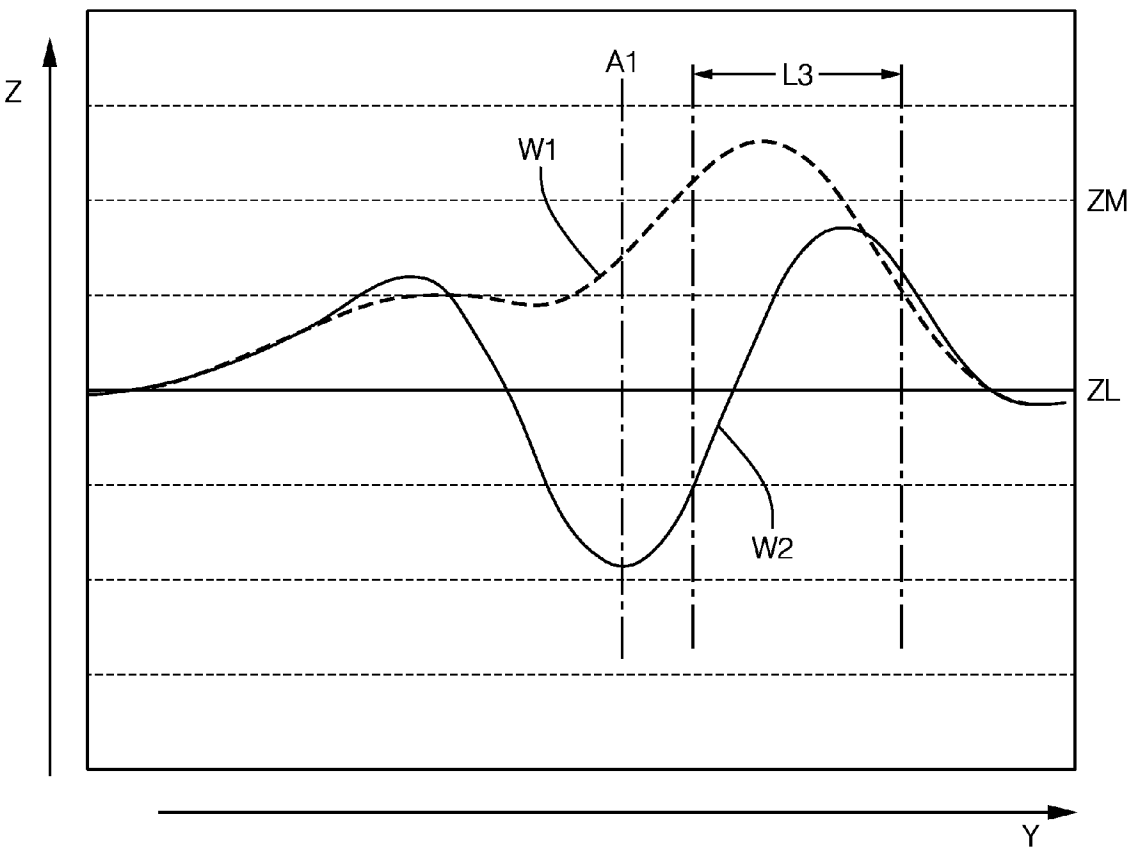
FIG. 7 shows a diagram of the impedance curve along the cable according to one embodiment.

FIG. 7 shows a diagram of the impedance curve W1, W2 along the end portion L2 of the cable 1 to the conductive trace of the circuit board 40. The curve W1 shows the impedance Z without compensation. The impedance Z in the connector area L3 is clearly higher than the line impedance ZL, which is typically 100 a In particular, the peak value of the impedance ZM in the area L3 can result in interference during data transmission. The curve W2 shows the impedance curve with compensation. The impedance Z fluctuates around the value of the line impedance TL, but does not reach the peak value ZM of the impedance without compensation.

The inventors have observed that an impedance change is caused when a two-wire cable and a circuit board are connected together. In the area of the connector connection, the conductors are further apart than in the cable. As a result, the impedance is increased which has negative effects on the data transmission with high data rates. This negative effect can be positively influenced by the invention. To achieve this positive effect a compensation area with low impedance is generated in the end portion of the cable. This may, for example, be achieved by enclosing the conductors of the cable with metal or other electrically conductive materials as well as a material of high permittivity. The reducing of the distance of the conductors to each other likewise reduces the impedance in the compensation area. If the compensation area with reduced impedance and the connector system with the increased impedance are within the area of the system-relevant rise time, said compensation area acts compensatory on the connector system by the effect of filtering, i.e., the compensation area is adapted to compensate, at least partially, the excessive impedance of the connector. In Broad-R Reach therefore, 700 picoseconds correspond to about 66 mm (with $\epsilon_{r_eff}$=2.5 for a common insulation material). At higher frequencies, the end portion becomes smaller. The width of the compensation area and the impedance should be dimensioned such that for the compensation area and the connector together the accumulated deviations of the wave impedance curve, starting from the optimum value (100Ω with Broad-R Reach), are minimal before filtering. As a side effect of adding a compensation area, additional reflections in the high frequency range are generated. However, these are not in the system-relevant area and can therefore be accepted.

For compensation, a metal ring may be placed around the wires or a metal strip may be wound around the cable. Since the layer thickness is not of great importance for the effect, it is also conceivable to provide an electrically conductive coating by application of metal particles, conductive plastic or coating. Through the size of the area covered by the coating, the impedance curve along the cable may be set.

If instead or in addition a compensation area should be generated by approximating the conductors, the conductors in the compensation area need to be positioned closer to each other such that the desired impedance is achieved. The positioning of the conductors closer together can be performed in a variety of ways. For example, a clamping means in the form of a sleeve may be used which is attached by crimping technique in the compensation area and thus presses the conductors to each other. It is also conceivable that the clamping means is provided in two parts, wherein the two parts together comprise the compensation area and press together the conductors in between by screwing together. Countless clamping means are known in the art which can perform this task. If the clamping means consists of metal, the effect is additionally reinforced and the conductors need not be positioned as close together as with a clamping means of electrically non-conductive material.

Another way of positioning the conductors closer together and hold them together, is the heating of the insulation of the conductors in the area in which the insulations of the conductors are adjacent to each other. The heating of the area is performed until the insulation melts, thereafter compressing the insulation of the two conductors in such a way that the melted areas merge. Thereafter, the insulations needs to be kept in this position until the melted insulation material solidifies and the insulations of the conductors are welded together. Upon compression of the melted insulation, the distance of the conductors to each other is determined and fixed after cooling. When heated, the deformation of the insulation is easy to achieve, that's why adding heat energy can be advantageous even in processes in which the insulation should be not be melted but only deformed. The parameters of the processes for producing the compensation areas need to be determined only once for the plant so that mass production of the cable is possible.

The invention claimed is:

1. A cable, comprising:

at least two conductors separated from each other and connectable to contact elements; and a compensation area within an end portion of the cable, wherein a distance of the at least two conductors from each other is smaller within the compensation area than outside the compensation area, thereby decreasing an impedance of the cable within the compensation area.

2. The cable according to claim 1, further comprising a clamping means configured to engage the cable in the compensation area and press it together such that the distance of the at least two conductors from each other is reduced.

3. The cable according to claim 1, wherein an intermediate layer extends, at least in sections, between the cable and the clamping means.

4. The cable according to claim 3, wherein the intermediate layer has a higher permittivity than the clamping means.

5. The cable according to claim 1, wherein the at least two conductors are each surrounded by circumferential insulation, and wherein the insulation surrounding each of the at least two conductors are welded together at least in the compensation area.

6. The cable according to claim 1, wherein a length of the compensation area is less than 70 millimeters.

7. The cable according to claim 1, wherein a length of the compensation area and the distance of the at least two conductors from each other are selected such that a predetermined impedance value is not exceeded.

8. A method of manufacturing a cable, comprising the steps of:

providing a cable having at least two conductors which are separated from each other by insulation in a compensation area within an end portion of the cable;

reducing a distance of the at least two conductors from each other within the compensation area; and fixing the distance of the at least two conductors from each other within the compensation area.

9. The method of manufacturing a cable according to claim 8, wherein the steps of reducing the distance of the at least two conductors from each other and fixing the distance of the at least two conductors from each other are performed by clamping using a clamping means.

10. The method of manufacturing a cable according to claim 8, wherein the steps of reducing the distance of the at least two conductors from each other and fixing the distance of the at least two conductors from each other are performed by introducing thermal energy into the compensation area such that the insulation is welded.

11. The method of manufacturing a cable according to claim 8, wherein the step of reducing the distance of the at least two conductors from each other includes introducing thermal energy into the compensation area.

* * * * *